United States Patent [19]

Jochums et al.

[11] 4,266,484

[45] May 12, 1981

[54] RACK-RAIL ASSEMBLY FOR A MINING MACHINE

[75] Inventors: Peter Jochums, Essen; Klaus Stratmann, Bochum; Egon Henkel, Essen; Heinrich Wildforster, Gelsenkirchen-Buer, all of Fed. Rep. of Germany

[73] Assignee: Hauhinco Maschinenfabrik G. Hausherr, Jochums & Co. KG, Essen, Fed. Rep. of Germany

[21] Appl. No.: 10,534

[22] Filed: Feb. 8, 1979

[30] Foreign Application Priority Data

Feb. 11, 1978 [DE] Fed. Rep. of Germany ..... 2805799

[51] Int. Cl.[3] ..... B61C 11/00; E01B 5/04

[52] U.S. Cl. ..... 105/29 R; 104/172 R; 238/123

[58] Field of Search ..... 105/29 R; 238/123; 104/172 R, 172 C, 287, 165

[56] References Cited

U.S. PATENT DOCUMENTS

| | | | |
|---|---|---|---|
| 3,854,418 | 12/1974 | Bertin | 105/29 R |
| 4,082,361 | 4/1978 | Lantermann | 105/29 R |

*Primary Examiner*—Richard A. Bertsch

*Attorney, Agent, or Firm*—Karl F. Ross

[57] ABSTRACT

A rack-rail assembly for a mining machine has a pair of relatively long rail sections longitudinally generally aligned with each other and having respective forked ends juxtaposed at a joint location. A relatively short link at this joint location has at each of the forked ends an outwardly projecting pin that engages in elongated holes of the forked ends so that limited relative longitudinal displacement between the rail sections and the link is possible. This link has at least two teeth and each of the rail sections has a plurality of teeth, so that when a mining machine travels along the rail assembly thus formed variations in tooth spacing at the joint location can be compensated for. A damping or spring member is provided between each of the rail sections and the link, normally urging them apart.

11 Claims, 6 Drawing Figures

RACK-RAIL ASSEMBLY FOR A MINING MACHINE

FIELD OF THE INVENTION

The present invention relates to a rack-rail assembly for a mining machine. More particularly this invention concerns such an assembly for use as a track to convey a coal cutter or the like.

BACKGROUND OF THE INVENTION

Various mining machines, such as those of Goodman type, displace themselves among cog or rack track comprising a plurality of racks aligned longitudinally and connected together at their ends. The mining machine has a pair of sprockets over which is spanned a chain whose rollers or cross pieces engage the teeth of the racks for displacement of the mining machine.

Normally the machine is associated with an elongated trough formed of individual sections each of which is provided with a respective rack-rail section. The joints between the individual rack-rail sections are normally provided at the approximate centers of the trough sections, so as to minimize flexing and ensure the proper alignment of the rail sections.

German patent publication No. 2,530,754 (whose U.S. equivalent is U.S. Pat. No. 4,082,361) shows such a system wherein the rail sections are connected together at their ends by means of simple pins or bolts which allow limited flexing at the joints. This arrangement has the advantage of simplicity and ease of servicing, yet nonetheless normally results in considerable wear of the teeth at the ends of the rail sections. This wear is due to the fact that when the two rail sections are not perfectly aligned with each other the spacing between the two teeth immediately flanking the joint will be more or less than the spacing between the teeth offset from the joint. Thus as the mining machine travels across the joint at least one of the teeth is going to be extremely heavily loaded for a moment, resulting in damage and premature wear to the teeth.

OBJECTS OF THE INVENTION

It is therefore an object of the present invention to provide an improved rack-rail assembly for a mining machine.

Another object is the provision of such a rail assembly which allows the mining machine to traverse a joint between adjacent rail sections without damage to the teeth at the joint, even when the rail sections are not perfectly aligned.

SUMMARY OF THE INVENTION

These objects are attained according to the instant invention in a rack-rail asembly having a pair of elongated and relatively long rail sections longitudinally generally aligned with each other and having respective ends juxtaposed at a joint location at which is provided a relatively short link. Means connects each of the rail-section ends to the link at the location for only limited relative longitudinal displacement between the rail-section ends and the link. A row of longitudinally substantially equispaced teeth is provided on this assembly and includes section teeth on the rail sections and at least two link teeth on the link. Thus as a mining machine having a pair of longitudinally spaced wheels over which is spanned an endless chain having a succession of cross pieces travels over the joint the limited relative motion of the link and rail sections allows longitudinal force transmission to be smoothly passed from one rail section to the link and then to the other rail section, without excessively overloading of any of the teeth.

According to further features of this invention spring or damping means is provided for urging each of the rail-section ends away from the link, so as normally to form a gap between the two confronting ends of the rail sections.

According to further features of this invention the link has a pair of end parts and each of the rail-section ends has an end part longitudinally overlapping and forming an end-part pair with the respective end part of the link. One of these end parts of each of the end-part pairs is formed with a laterally projecting pin and the other end-part of each of the end-part pairs is formed with a recess loosely receiving the respective pin. Thus these pins and the recesses together allow only limited relative longitudinal displacement between the rail-section ends and the link, the rail-sections and the link being at least limitedly relatively pivotal about these pins.

It is also within the scope of this invention to provide a bidirectional damping member between the link and the end of each of the rail sections. A simple dashpot arrangement can be employed.

More particularly according to this invention the end part of each of the rail sections is forked, having a pair of sides each formed with an elongated hole or slot constituting the recess in which the pin is received. These pins are unitarily formed with the link and each extend to both sides of the link, so that both sides of the forked end part of the rail section are engaged.

SPECIFIC DESCRIPTION

Figure 1:
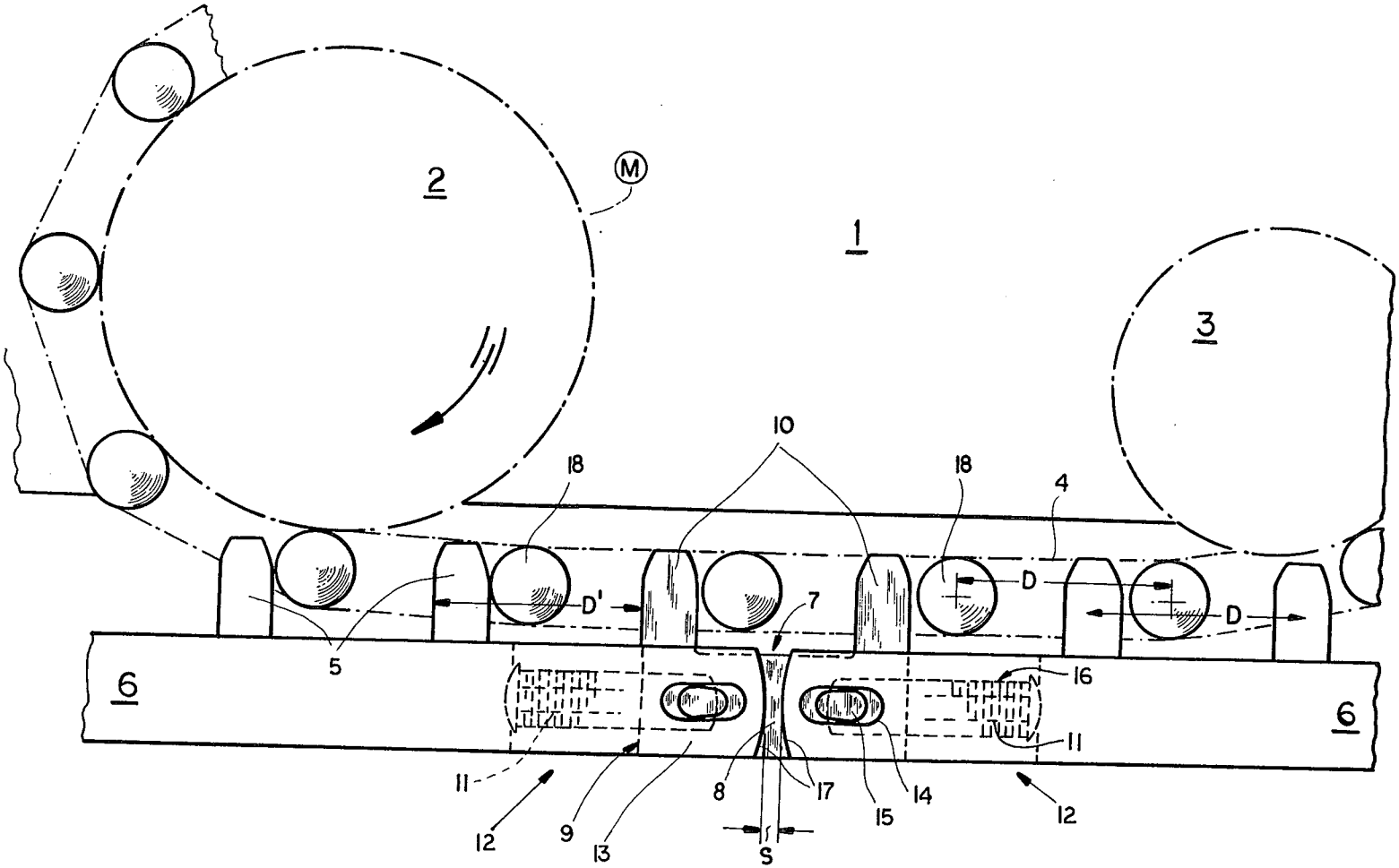
FIG. 1 is a side view of the assembly according to this invention.

As shown in FIG. 1 a mining machine 1 has a drive sprocket 2 and driven by a motor M an idler sprocket 3 interconnected by a silent or roller chain 4 having a succession of pins or cross pieces 18 spaced apart by a distance D. A pair of rack-rail sections 6 are connected together at a joint location 7 by means of a link 9. The rail sections 6 have teeth 5 spaced apart by the distance D and the link 9 has a pair of teeth 10 also spaced apart by the distance D.

The rail sections 6 have forked ends 12 with rounded confronting surfaces 17 but can be separated by a space 8 having a dimension S. Damping members or spring packs 11 are engaged between the link 9 and rail sections 8 and normally urge them longitudinally apart so that the spacing D between the last rail tooth 5 and the adjacent link tooth 10 is greater than D.

Figure 5:
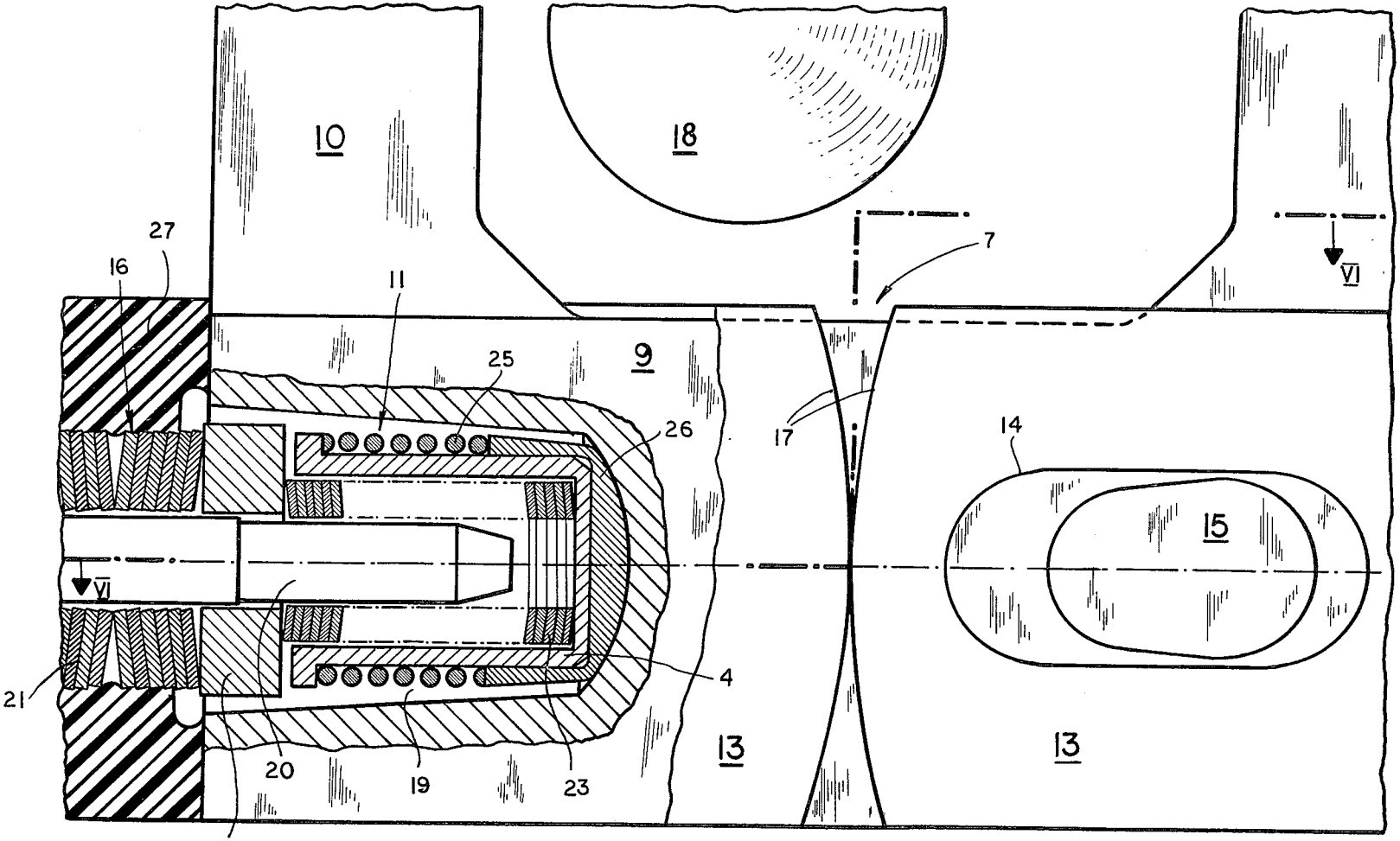
FIG. 5 is a large-scale partly sectional view of a detail of FIG. 1.
Figure 6:
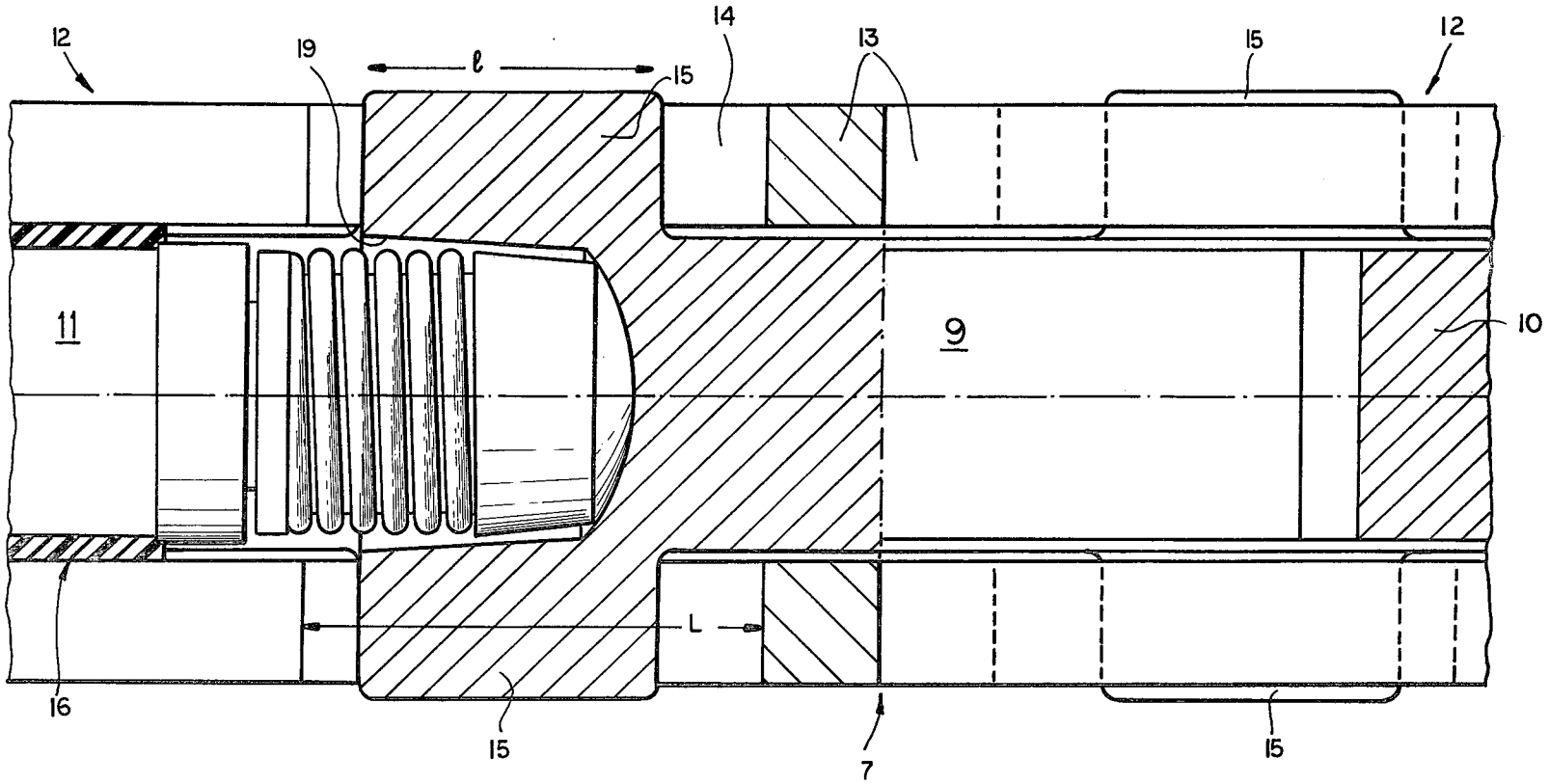
FIG. 6 is a section taken along line VI—VI of FIG. 5.

As shown in more detail in FIGS. 5 and 6 the forked ends 12 of the sections 6 have sides or flanges 13 each formed with a longitudinally elongated hole or slot 14 in which engages a slightly elongated pin 15 unitarily formed with the link 9 and of a longitudinal length 1 equal to approximately $\frac{2}{3}$ of the longitudinal length L of the holes 14. Thus displacement of each of the rails 6 relative to the link 9 through a distance equal to the difference between the length L and 1 is possible. Each of the end parts 12 is formed with a chamber 16 receiving the damping member 11, and the outer ends of the link 9 are similarly formed with an outwardly open recess or compartment 19. The damping members each comprise a central pin 20 normally fixed in the rail section 6 and surrounded in the chamber 16 by a stack 21 of Belleville washers surrounded by an elastomeric seal 27. Each of these pins 20 extends through an abutment washer 22 into the chamber 19. In the chamber 19 another stack of Belleville washers 23 is braced between the washer 22 and a cup 24 having a shoulder against which bears one end of a compression spring 25 bearing at its other end on another cap 26 having a part-spherical surface bearing on the complementarily formed end surface of the recess 19. Thus the combined action of the spring packs 21 and 23 with the spring 25 urges the rail sections 6 apart at the joint location.

Figure 2:
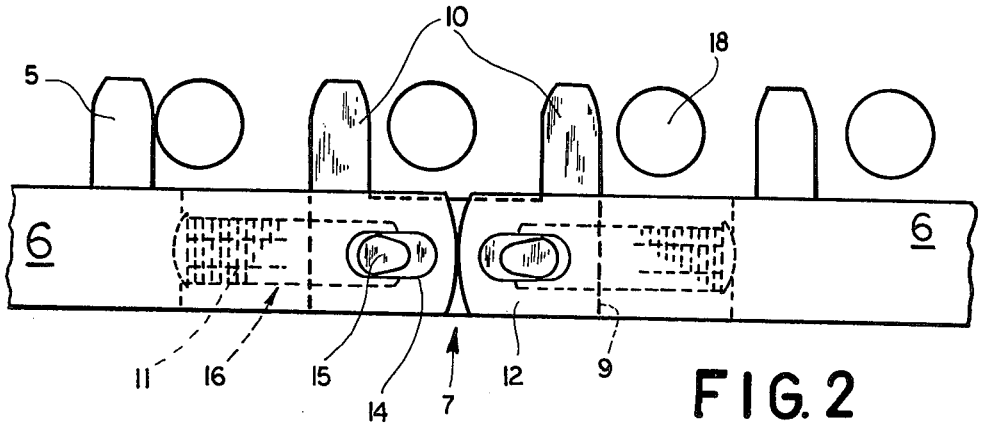
FIGS. 2–4 are side-view details showing the operation of the assembly according to this invention.
Figure 3:
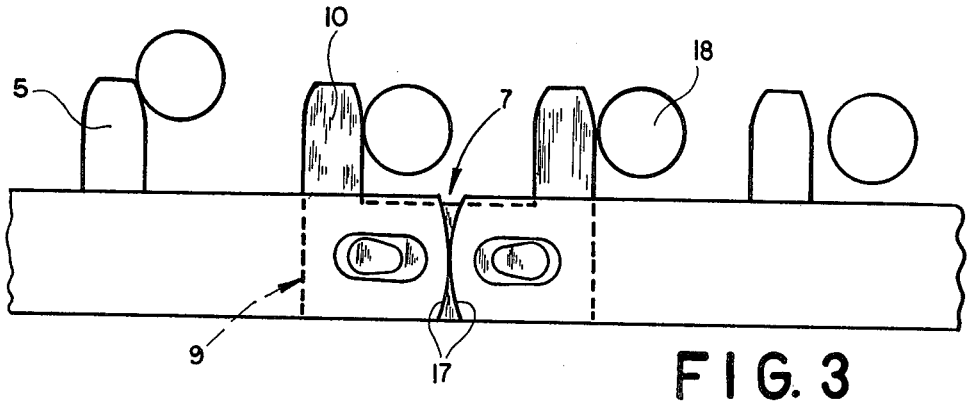
Figure 4:
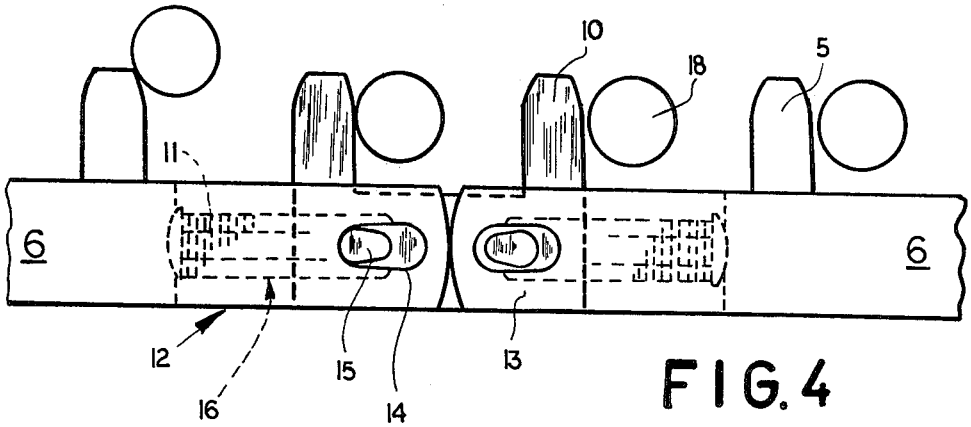

As the drive sprocket 2 is rotated in the clockwise direction, normally by a worm drive, the cross pieces 18 will be pulled out of the downstream, here left-hand, rail section 6. Thus as shown in FIGS. 2–4 it is possible for the spacing between the rounded ends 17 of the rail sections 6 to vary, and it is similarly possible for the link 9 to move in one direction or the other relative to both of the rail sections 6. When the rail sections 6 are not perfectly longitudinally aligned this action allows any minor variations in the spacing D between the teeth 10 and the adjacent teeth 5 to be compensated for without excessive wear of any of the teeth 5 or 10. The damping or spring element 11 is so very stiff that good force transmisson is possible, yet without subjecting any of the teeth 5 or 10 to excessive strain.

The rounded ends 11 abut in point or most line contact, so that wear of these members is minimized. It is noted that one of the side parts 13 of each forked end 12 may be removable for assembly of the joint.

We claim:

1. A rack-rail assembly comprising:

a pair of elongated and relatively long rail sections longitudinally generally aligned with each other and having respective ends juxtaposed at a joint location;

a relatively short link at said joint location, said link having a pair of end parts and each of said ends having an end part longitudinally overlapping and forming an end-part pair with the respective end part of said link, one of said end parts of each of said end-part pairs being formed with a laterally projecting pin and the other end part of each of said end-part pairs being formed with a recess loosely receiving the respective pin, said pins and recesses together constituting said means, said sections and link being at least limitedly relatively pivotal about said pins;

means connecting each of said ends to said link at said location for only limited relative longitudinal displacement between said ends and said link; and a row of longitudinally substantially equispaced teeth including section teeth on said sections and at least two link teeth on said link.

2. The assembly defined in claim 1 wherein said pins are formed on said link and said recesses on said sections.

3. The assembly defined in claim 1 wherein each of said recesses is a longitudinally elongated slot.

4. The assembly defined in claim 1 wherein each of said end parts of said sections has a pair of sides each formed with a respective such recess, each of said pins projecting to both sides of said link and engaging in both of the recesses of the end part of the respective section.

5. The assembly defined in claim 1 wherein said ends of said sections are rounded and engageable with each other with at most line contact.

6. The assembly defined in claim 1, further comprising spring means between said ends and said link for urging said ends longitudinally away from said link.

7. The assembly defined in claim 1, further comprising:

a pair of longitudinally spaced wheels;

an endless chain spaced over said wheels and having a succession of cross pieces equispaced by the same spacing as said section teeth, said cross pieces being engageable with said teeth; and means for driving one of said wheels to advance said chain and thereby displace said wheels along said sections.

8. A rack-rail assembly comprising:

a pair of elongated and relatively long rail sections longitudinally generally aligned with each other and having respective ends juxtaposed at a joint location;

a relatively short link at said joint location;

spring means between said ends and said link for urging said ends longitudinally away from said link;

means connecting each of said ends to said link at said location for only limited relative longitudinal displacement between said ends and said link; and a row of longitudinally substantially equispaced teeth including section teeth on said sections and at least two link teeth on said link.

9. The assembly defined in claim 8 wherein said spring means includes spring packs braced between said ends and said link.

10. The assembly defined in claim 8 wherein said link teeth are of the same pitch as said section teeth.

11. A rack-rail assembly comprising:

a pair of elongated and relatively long rail sections longitudinally generally aligned with each other and having respective ends juxtaposed at a joint location, said ends of said sections being rounded and engageable with each other with at most line contact;

a relatively short link at said joint location;

means connecting each of said ends to said link at said location for only limited relative longitudinal displacement between said ends and said link; and a row of longitudinally substantially equispaced teeth including section teeth on said sections and at least two link teeth on said link.

* * * * *